US010780959B1

(12) United States Patent
Ung

(10) Patent No.: US 10,780,959 B1
(45) Date of Patent: Sep. 22, 2020

(54) SWIMMING AID

(71) Applicant: Victor Ung, Honolulu, HI (US)

(72) Inventor: Victor Ung, Honolulu, HI (US)

(73) Assignee: LULUBOB LLC, Honolulu, HI (US)

( * ) Notice: Subject to any disclaimer, the term of this patent is extended or adjusted under 35 U.S.C. 154(b) by 0 days.

(21) Appl. No.: 16/574,008

(22) Filed: Sep. 17, 2019

(51) Int. Cl.
*B63C 9/115* (2006.01)

(52) U.S. Cl.
CPC ..... *B63C 9/115* (2013.01)

(58) Field of Classification Search
CPC ..... B63C 9/115
See application file for complete search history.

(56) References Cited

U.S. PATENT DOCUMENTS 2,807,035 A * 9/1957 Phillips ..... B63C 9/115 441/115
4,047,255 A * 9/1977 Kiefer ..... B63C 9/115 441/110
5,348,505 A 9/1994 Rothhammer
5,746,632 A * 5/1998 Theberge ..... B63C 9/115 441/115
8,591,275 B2 11/2013 Gonsalves et al.

FOREIGN PATENT DOCUMENTS

JP 3074293 U * 12/2000 ..... A41D 13/015
JP 3211678 U 7/2017
KR 20-2009-0009381 9/2009
KR 20-2013-0007236 U 12/2013

* cited by examiner

*Primary Examiner* — Stephen P Avila
(74) *Attorney, Agent, or Firm* — Martin E. Hsia

(57) ABSTRACT

A swimming aid with a lower back float and an abdominal float, where the floats provide sufficient buoyancy to keep the user's head, neck and shoulders above water when the user is in a vertical position and in a mostly horizontal position. The floats overlap axially so that the user is biased to a vertical position, but can easily rotate between a mostly horizontal position for learning how to swim, and a vertical position, with head, neck and shoulders above the water in both positions, for ease and comfort of breathing, without falling over backwards or sideways.

12 Claims, 6 Drawing Sheets

SWIMMING AID

TECHNICAL FIELD

The present invention relates to a swimming aid that makes learning how to swim a comfortable, secure, and enjoyable experience for non-swimmers, young or old, and that also enables persons to exercise in the water, or swim, without expending the physical exertion necessary to swim and breathe simultaneously, such as the elderly or the injured.

BACKGROUND ART

Persons learning to swim do not want to submerge their faces in the water, because they would not be able to breathe air through their noses or mouths. When in a vertical position, most people do not float high enough in the water for their noses or mouths to be above the water, unless they are treading water or otherwise paddling. However, swimming must be done when the swimmer is horizontal, so that the arms and legs can be submerged in water and propel the swimmer. When a person is horizontal in the water, his or her face is submerged, unless the person is floating on his or her back. But when floating on the back, the smallest wave will wash over the person's face, and the person will not be able to breathe. Further, a non-swimmer cannot learn how to swim if restricted only to floating on the back (except possibly the back stroke). Moreover, for many swimming strokes, learning how to breathe is part of learning the stroke, but a non-swimmer who does not know any strokes will not want to be in water without knowing how he or she will be able to breathe.

Most importantly, when a non-swimmer learning to swim is horizontal in the water, with his or her face submerged, it is difficult for him or her to get back to a vertical position, with the nose and mouth high enough above the water, so that he or she can comfortably breathe. These factors all make it scary and difficult for non-swimmers to learn how to swim, so they avoid learning how to swim.

Also, even if a person knows how to swim, he or she may not be able to, or want to, expend the physical exertion necessary to swim and breathe simultaneously, such as the elderly or persons recovering from injuries. However, these persons may still want to swim, or exercise in the water.

Devices to enable persons to float have been known for millennia. Most such devices have been designed to keep the user vertical when in the water, with the nose and mouth above water, as in conventional life vests. However, for compactness and economy, most such devices are attached to the user's chest and only provide sufficient buoyancy to raise the user's head out of the water, which does not give sufficient security to a user who is a non-swimmer, especially because any waves could send water over the user's nose and mouth. Further, if the user is only supported by a flotation device over the chest, it is very difficult to rotate the entire body from a vertical position to a horizontal position, because the leverage of the entire lower portion of the body must be overcome in order to rotate around the chest and become horizontal. Further, a person cannot learn to swim (in a horizontal position) when being maintained in a vertical position by such devices. Thus, these devices make it too difficult for a non-swimmer to rotate from a vertical position to a horizontal position. Life jackets or life saving rings (commonly called "lifesavers") also constrain the user's arms from freely moving, which also makes it difficult to learn how to swim.

Devices that provide flotation to the lower part of a user's torso are also known, such as flotation belts, but (in addition to the problems described above), if the user rotates to a horizontal position to learn swimming, the user must then exert effort against his or her full body weight, without any assistance, to become vertical again, in order to breathe through the nose or mouth. Thus, these devices do not make it easier for a non-swimmer to rotate from a horizontal position to a vertical position to breathe. Further, if the user tips over onto his or her back, that can be very frightening to a non-swimmer. These devices also may not provide sufficient buoyancy.

Other devices, such as the floatation aid disclosed in U.S. Pat. No. 5,746,632 to Theberge, have two floatation devices designed to support a person in a horizontal position in the water. However, for a non-swimmer, because the upper floatation device is on the chest, this means that the device is biased to place the user in a horizontal position, with the nose and mouth submerged, which is scary for a non-swimmer and makes it difficult to learn to swim. Further, because this device has a flotation device on the chest, and is designed to support the user in a horizontal position, the user must exert substantial effort to come back to a vertical position in the water to free the nose and mouth for breathing. The user is not assisted to return to a vertical position for breathing because, although the chest float assists in the first portion of rotating to vertical, after the chest float comes out of the water, the weight of the chest float hinders completing the rotation to a vertical position.

U.S. Pat. No. 4,047,255 to Kiefer, incorporated herein by reference, discloses a trapeze harness meeting the requirements for a life-saving vest, having a back section and two front flotation sections connected together over the chest of the wearer, with the bottom edges of the front flotation sections above the bend line of the waist of the wearer, and with the center of flotation in the front of the wearer and as high as possible to roll the person over and have his face out of the water (col. 1, line 44, to col. 2, line 1).

U.S. Pat. 5,746,632 to Theberge, incorporated herein by reference, discloses a floatation aid which includes a harness and two floatation devices positioned over the chest and the lower back to support a person's body in a horizontal position while in the water, without impeding movement of the person's limbs or torso.

Airtime Watertime, Inc. sells a wetsuit with a sewn in flotation panel bladder as a swimming aid, a photo of which was filed as a specimen on Mar. 5, 2018, in U.S. Pat. No. 5,470,441 for "FLOATER" for "Wetsuits featuring an air bladder for added buoyancy".

Thus, there is a need for a swimming aid that avoids these and other disadvantages of existing flotation devices, to make it easy and secure for a non-swimmer to breathe when in a vertical or horizontal position, and allows a non-swimmer to rotate easily from a vertical position to a horizontal position, to learn to swim, and to rotate from a horizontal position to a vertical position, to easily breathe, thereby providing a feeling of security, comfort, and control to a non-swimmer. The device also must not impede movement of the user's arms and legs, which must be free for learning various strokes for swimming.

DISCLOSURE OF THE INVENTION

The present invention is a swimming aid for supporting a user in water that has a lower back float retainable around the user's lower back; a lower harness adaptable to retain the lower back float around the user's lower back; an abdominal float retainable against the user's abdomen; and an abdominal harness adaptable to retain the abdominal float against the user's abdomen. The floats provide sufficient buoyancy to keep the user's head, neck and shoulders above the water when the user is in a vertical position and in a mostly horizontal position. By mostly horizontal is meant that the user is not completely horizontal, but is close enough to horizontal to be able to use swimming strokes to swim. In the remainder of this patent, the term "horizontal", when used alone, includes both mostly horizontal and completely horizontal. The lower back float provides greater buoyancy than the abdominal float, to bias the user against falling backwards or sideways. When the lower harness and the abdominal harness are worn by the user, the lower back float is retained around the user's lower back and the abdominal float is retained against the user's abdomen, and the bottom edge of the abdominal float is below the top edge of the lower back float when the user is in a vertical position in the water, so that the floats overlap axially. By axially is meant the direction along the axis of the torso, from the head to the bottom of the torso, which would be vertical if the person is standing upright, or horizontal if the person is horizontal. In this manner, the abdominal float and the lower back float are axially close enough that the user is biased to a vertical position, but the user can easily rotate between a mostly or completely horizontal position for learning how to swim, and a vertical position, with head, neck and shoulders above the water, for ease and comfort of breathing, without falling over backwards or sideways.

Because the abdominal float retained against the abdomen instead of the chest, it provides constant buoyancy assistance to the user at all times when rotating from the mostly or completely horizontal to a vertical positions, because it is always submerged, as opposed to a float over the chest, which would provide less buoyancy assistance as portions come out of the water.

Alternatively, the lower harness and the abdominal harness can be integrally formed.

Practically, the lower back float subtends an angle of between about 180 degrees and about 250 degrees around the back of the user. Preferably, the lower back float subtends an angle of between about 190 degrees and about 240 degrees around the back of the user. Optimally, the lower back float subtends an angle of between about 210 degrees to about 230 degrees around the back of the user.

Preferably, the abdominal float comprises two abdominal sub-floats, adjustably joined together, such as by laces or straps, to allow adjustment of the separation between sub-floats, to accommodate different sizes of users, for example.

Practically, the abdominal float subtends an angle of between about 90 degrees and about 180 degrees around the abdomen of the user. Preferably, the abdominal float subtends an angle of between about 90 degrees and about 180 degrees around the abdomen of the user. Optimally, the abdominal float subtends an angle of between about 140 degrees to about 160 degrees around the abdomen of the user.

In a preferred embodiment, the invention is a swimming aid for supporting a user in water, including a lower back float covering the user's lower back and an abdominal float covering the user's abdomen, wherein the lower back float provides greater buoyancy than the abdominal float, and the floats provide sufficient buoyancy to keep the user's head, neck and shoulders above the water when the user is in a vertical position and in a mostly horizontal position.

Preferably, the lower back float subtends an angle of between about 190 degrees and about 240 degrees around the back of the user, the abdominal float subtends an angle of about 45 degrees around the abdomen of the user, and the abdominal float and the lower back float overlap axially. In this manner, the floats provide a restoring force to bias the user to a substantially vertical position in the water and bias the user against falling backwards or sideways. The abdominal float and the lower back float are axially close enough that the user is biased to a vertical position, but the user can easily rotate between a horizontal position for learning how to swim, and a vertical position, with head, neck and shoulders above water, for ease and comfort of breathing, without falling over backwards or sideways.

In another preferred embodiment, the invention is a swimming aid for supporting a user in water, including a lower back float covering a lower back portion of the user's torso and wrapping about ⅔ around the user at the user's lower back, and an abdominal float covering a front abdominal portion of the user's torso and wrapping about ⅛ around the user at the user's abdomen. The floats provide sufficient buoyancy to keep the user's head, neck and shoulders above the water when the user is in a vertical position and in a mostly horizontal position, and the lower back float provides greater buoyancy than the abdominal float. The abdominal float and the lower back float overlap axially, so that the abdominal float and the lower back float are axially close enough that the user is biased to a vertical position, but can easily rotate between a horizontal position for learning how to swim, and a vertical position, with head, neck and shoulders above water, for ease and comfort of breathing, without falling over backwards or sideways.

In an alternative embodiment, the invention is a swimming aid for supporting a user in water, including a float having a lower back portion having a top edge retainable against a user's lower back, and an abdominal portion having a bottom edge retainable against a user's abdomen, wherein the float provides sufficient buoyancy to keep the user's head, neck and shoulders above the water when the user is in a vertical position and in a mostly horizontal position. The portions overlap axially, because the bottom edge of the abdominal portion is below the top edge of the lower back portion when the user wears the device and is in a vertical position in the water. The abdominal portion and the lower back portion are axially close enough that the user is biased to a vertical position, but the user can easily rotate between a horizontal position for learning how to swim, and a vertical position, with head, neck and shoulders above water, for ease and comfort of breathing, without falling over backwards or sideways.

BEST MODES FOR CARRYING OUT THE INVENTION

The presently preferred best mode for practicing the present invention is illustrated by way of example in FIGS. 1 to 6.

Figure 1:
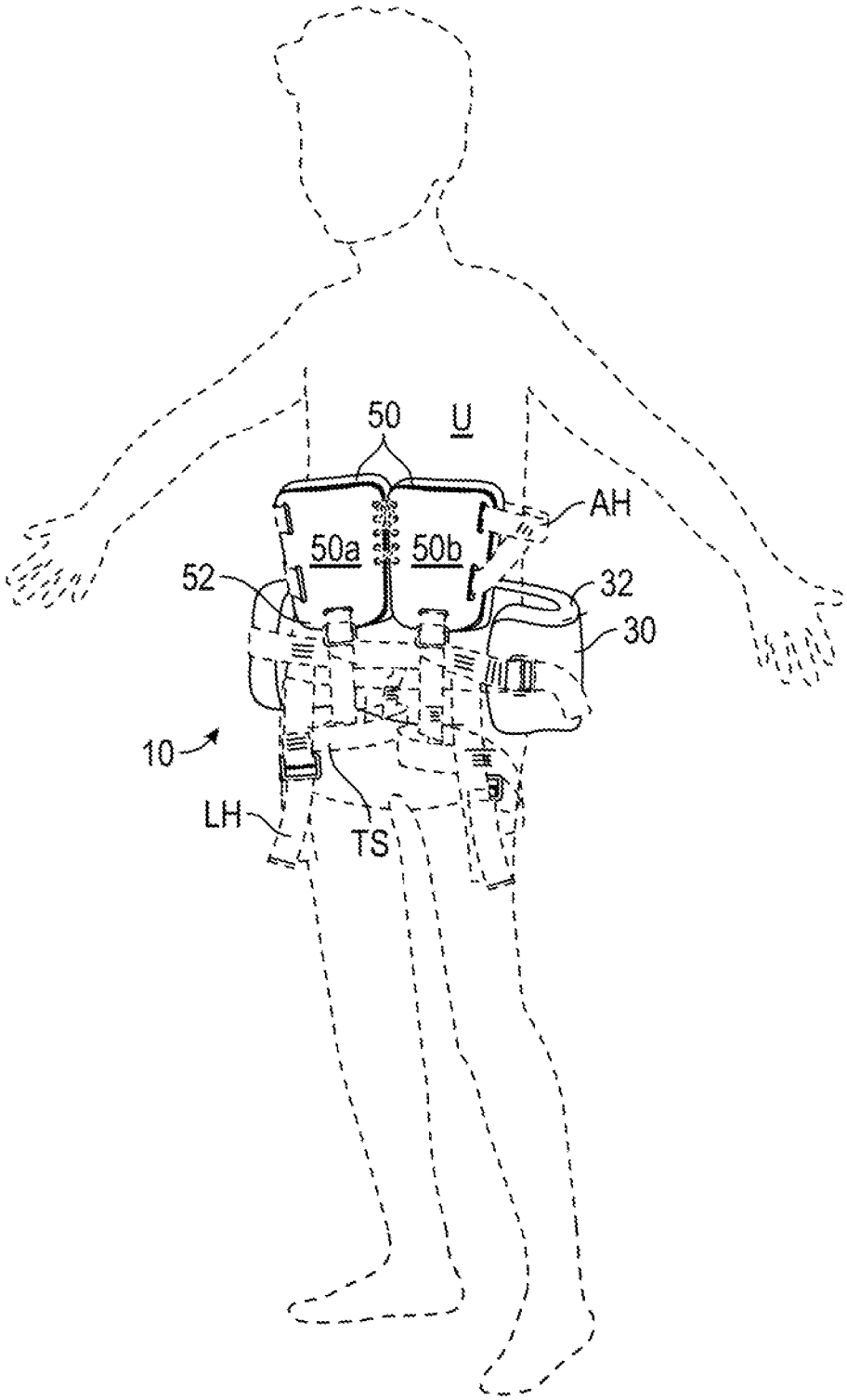
FIG. 1 is a perspective view from the front of a presently preferred embodiment of the invention.

Referring to FIG. 1, shown is a perspective view of a user U wearing the device 10, which has a lower back float 30 retainable around the user's lower back, and an abdominal float 50, preferably comprising left subfloat 50*a* and right subfloat 50*b*, retainable against the user's abdomen. By abdomen is meant the front portion of the user's abdomen, between the pelvis and the rib cage.

The lower back float 30 can be retained against the user's lower back by any suitable means. Shown is a lower harness LH having various straps that encircle the user at the lower back level and also extend underneath the crotch and down to the user's legs and include thigh straps TS, as in a rock climbing harness, but any other suitable means may be used instead. The lower harness LH preferably includes the thigh straps TS to help the lower harness LH prevent the lower back float 30 from riding up the user's body when floating.

The abdominal float 50 can be retained against the user's abdomen by any suitable means. Shown is an abdominal harness AH having various straps that encircle the user at the abdominal level and that optionally attaches to the lower harness LH.

The straps of the lower harness LH and abdominal harness AH can be attached and adjusted to each other and to the lower back float 30 and abdominal float 50, in any manner known in the art, including, without limitation, buckles and hook and loop fasteners (widely known under the trademark Velcro).

The lower back float 30 provides greater buoyancy than the abdominal float 50, and the floats together provide sufficient buoyancy that the user U floats with his or her head, neck and shoulders above the water, when the user U is in a vertical position and in a mostly horizontal position. Preferably, the lower back float 30 and the abdominal float 50 provide sufficient buoyancy to allow the user to more easily keep his or her head, neck and shoulders above the water when swimming in a horizontal position, to provide security when the user must learn to breathe in a stroke being learned.

The lower edge 52 of the abdominal float 50 is higher than the upper edge 32 of the lower back float 30, so that the floats overlap axially. Because the lower back float 30 and the abdominal float 50 overlap axially, there is a small moment arm (in other words, a small amount of leverage) between the floats, so that they do not create significant torque that must be overcome for the user to rotate from a vertical position to a mostly horizontal position, or to return to a vertical position from a mostly horizontal position. Yet, the abdominal float 50 provides assistance to the user to rotate from a horizontal position to a vertical position, so that the user does not need to exert effort against his or her full body weight, without assistance.

Figure 2:
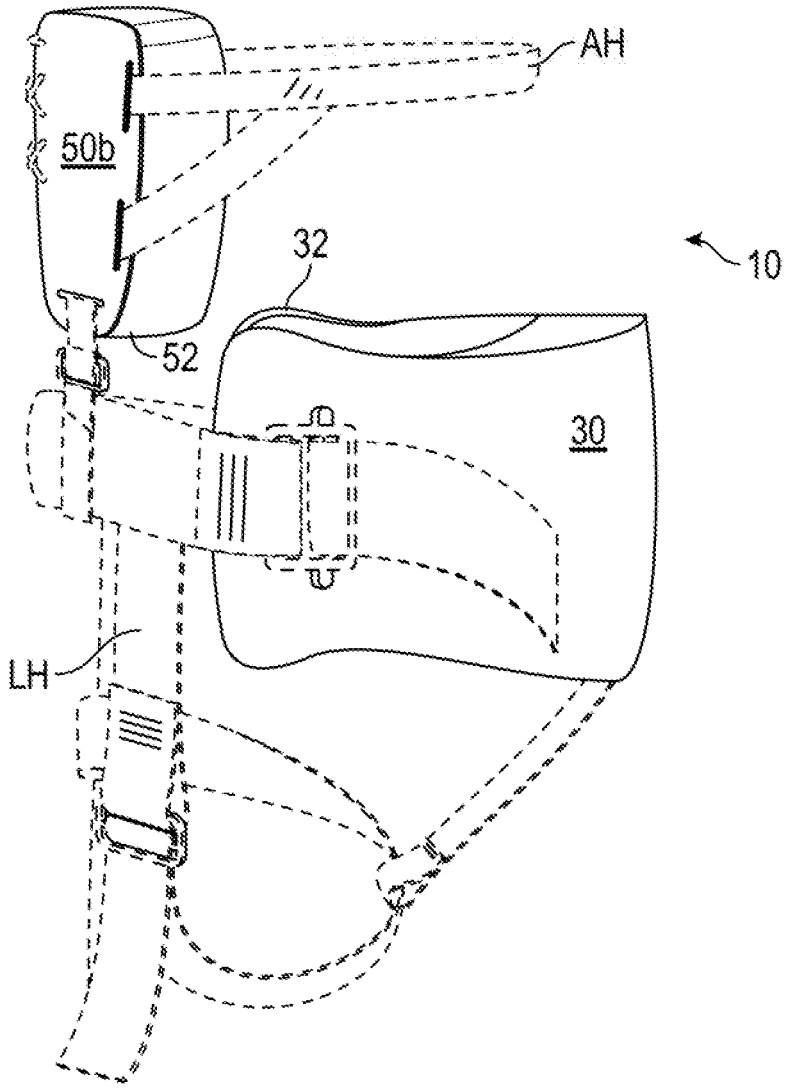
FIG. 2 is a side view thereof.

Referring to FIG. 2, shown is a side elevational view of the device 10, with the user omitted for clarity, showing the lower back float 30 and right abdominal subfloat 50*b*, as well as the lower harness LH and abdominal harness AH.

Figure 3:
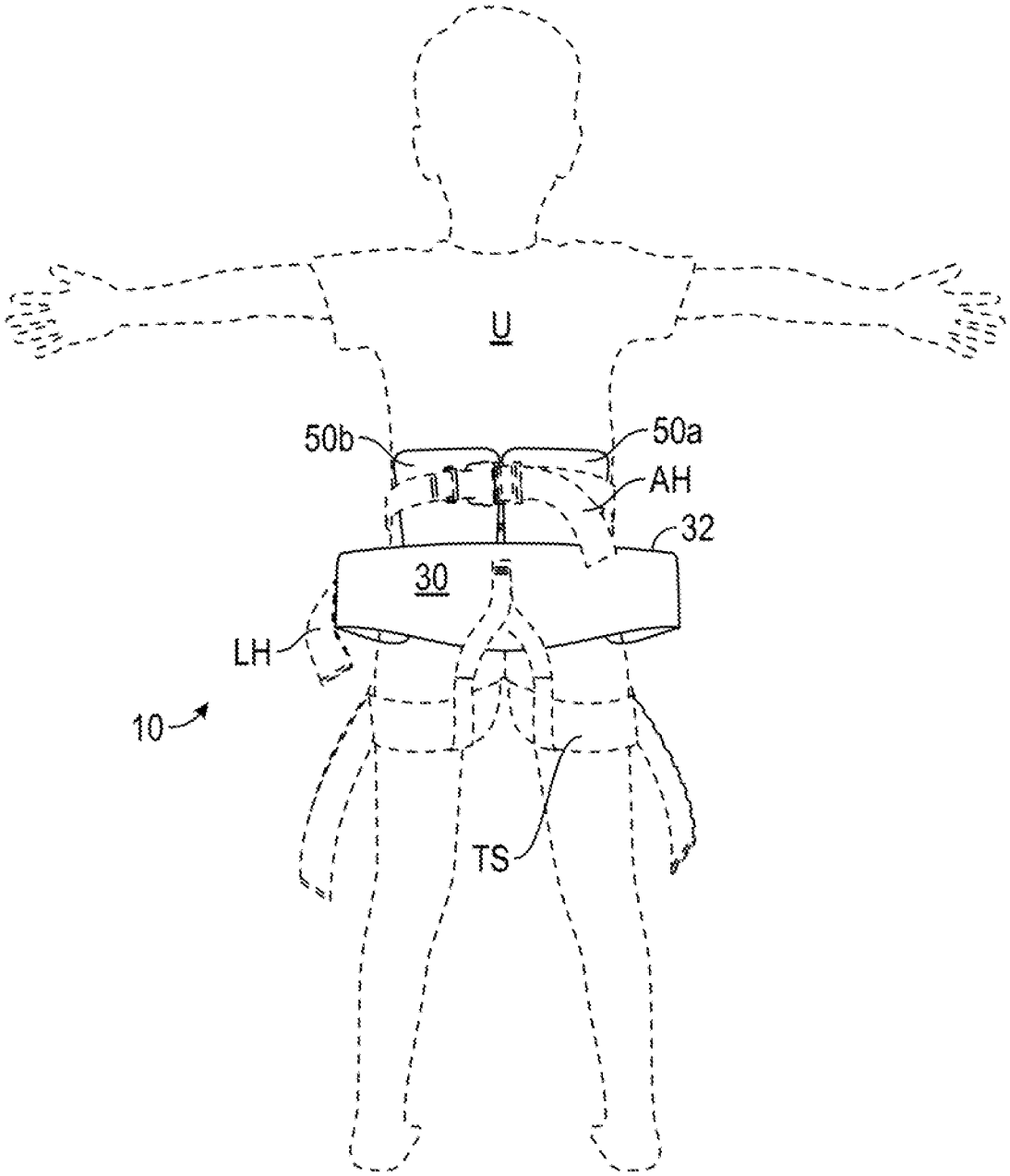
FIG. 3 is an elevational view from the rear thereof.

Referring to FIG. 3, shown is a rear elevational view of the device as worn by a user U, showing the lower back float 30 retained against the user's lower back by the lower harness LH, and the left abdominal subfloat 50*a* and right abdominal subfloat 50*b* retained against the user's abdomen by the abdominal harness AH.

Figure 4:
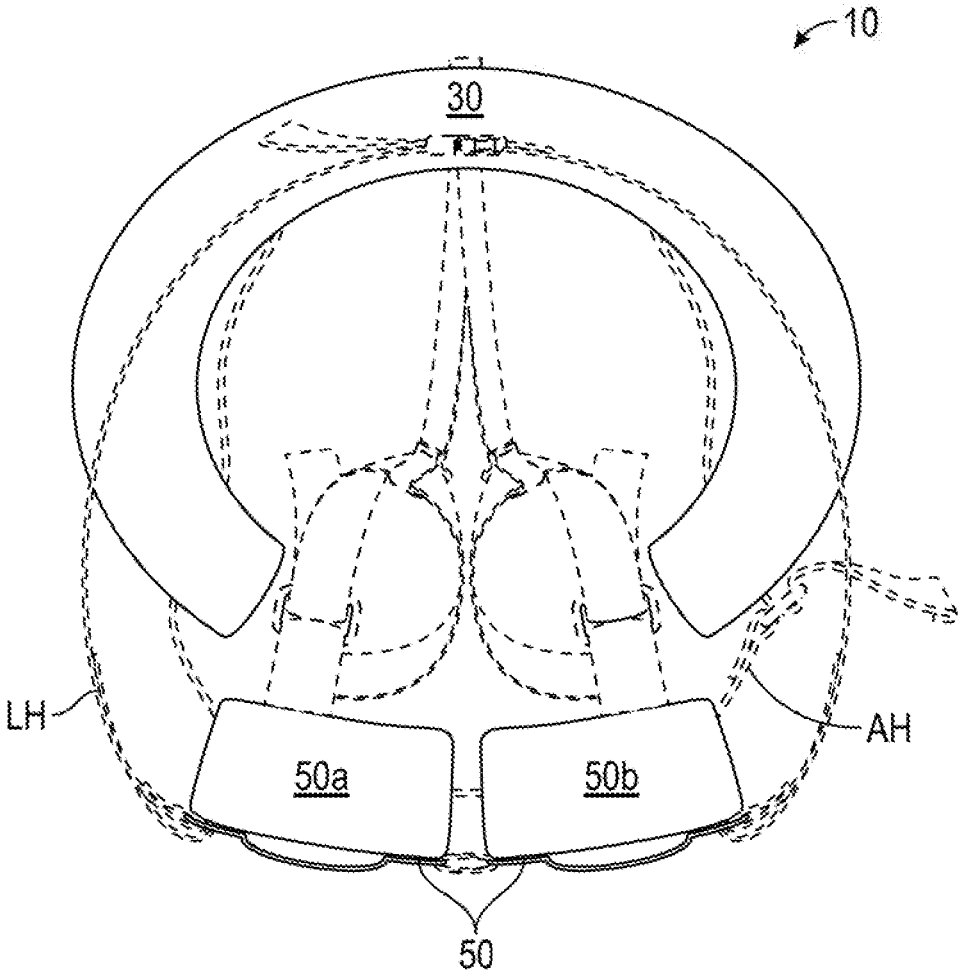
FIG. 4 is a top view thereof.

Referring to FIG. 4, shown is a top plan view of the device 10, showing the lower harness 30 going about ¾ around the user (subtending an angle around the user of about 270 degrees), and the abdominal float 50 (preferably comprising left abdominal subfloat 50*a* and right abdominal subfloat 50*b*) going about ⅛ around the user (subtending an angle around the user of about 45 degrees). Because the lower back float 30 encircles most of the user, it biases the user against tipping backwards or sideways.

Figure 5:
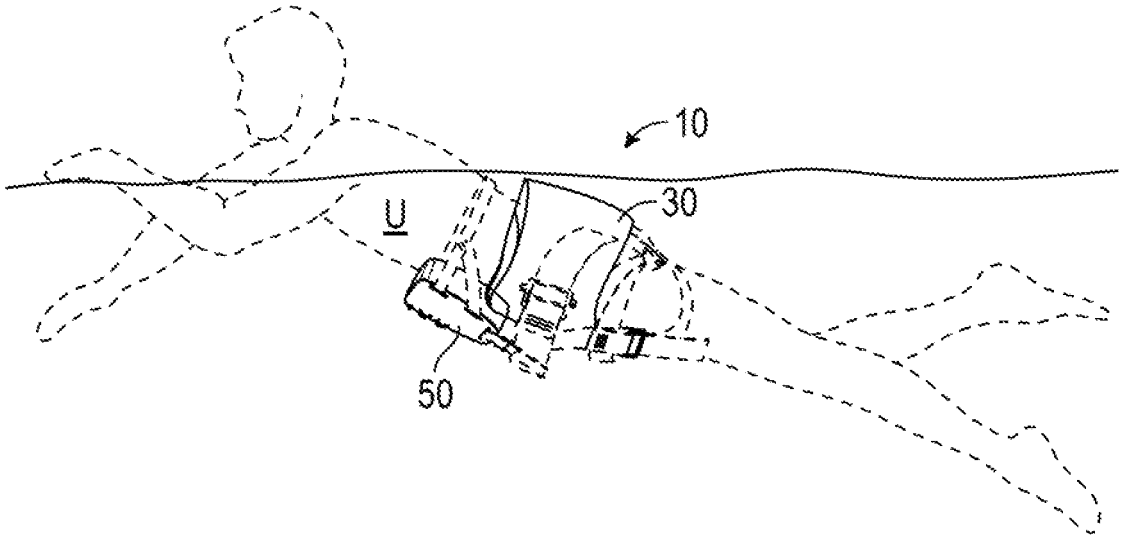
FIG. 5 is a side elevational view thereof, showing the orientation of the user when swimming in a mostly horizontal position.

Referring to FIG. 5, shown is the device 10 worn by a user U in a mostly horizontal position, for learning how to swim. As can be seen, because the abdominal float 50 provides less buoyancy than the lower back float 30, the user can easily rotate from a vertical position to a mostly horizontal position to learn how to swim, yet the abdominal float provides buoyancy to assist the user to rotate from the mostly horizontal position to a vertical position. The lower back float 30 and the abdominal float 50 provide sufficient buoyancy that the user's head, neck and shoulders can easily be kept above water when swimming. Because the lower back float 30 and the abdominal float 50 are retained only around the user's lower back and abdomen, the user's limbs and upper body are free to move to their full extend in any direction.

Figure 6:
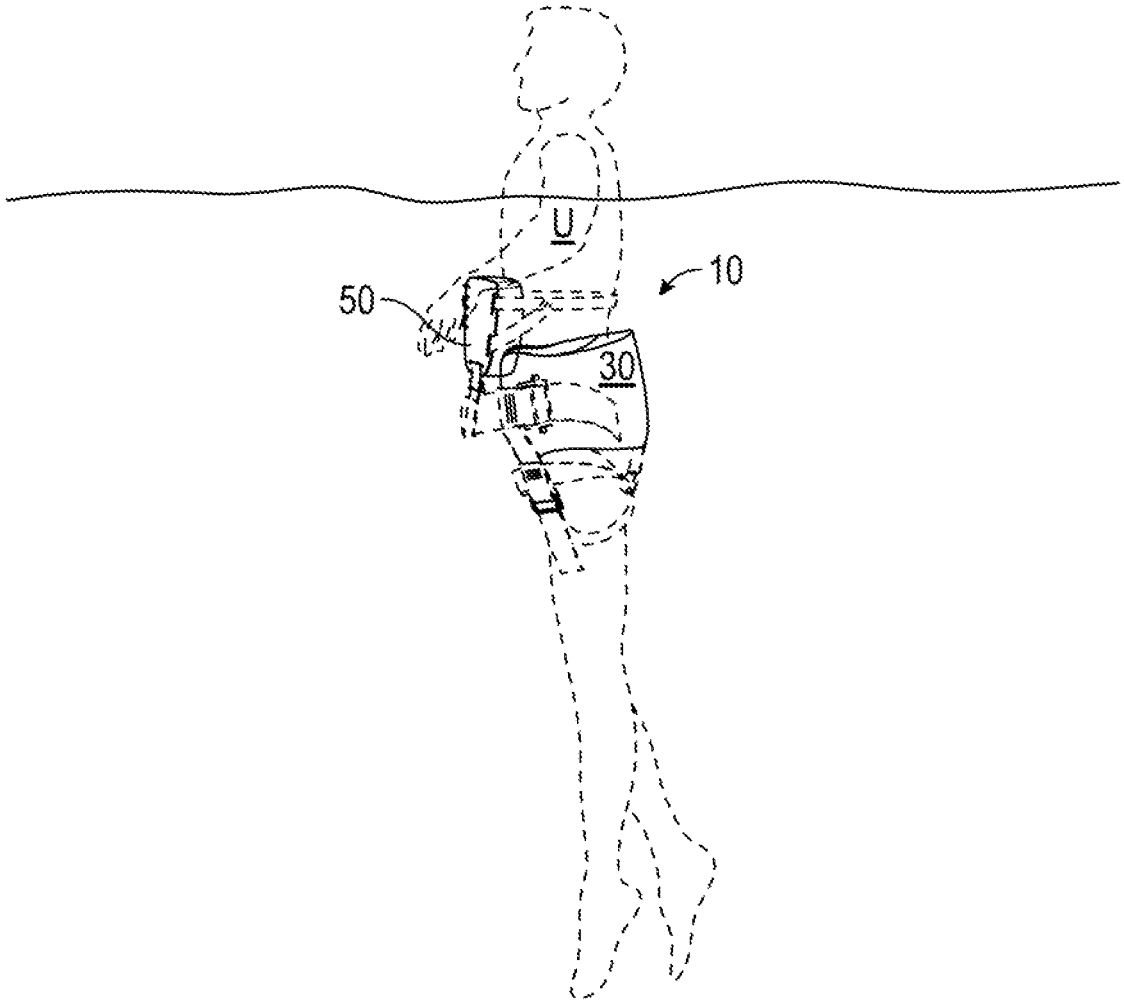
FIG. 6 is a side view thereof, showing the orientation of the user when floating in a vertical position.

Referring to FIG. 6, shown is a user U wearing the device 10 in a substantially vertical position, showing that the lower back float 30 and abdominal float 50 provide buoyancy sufficient to keep the user's head, neck and shoulders above the water. Also, the lower back float 30 biases the user against tipping over backwards or sideways. The abdominal float 50 is smaller than the lower back float 30, so that the user is slightly biases to tip forward, but the abdominal float 50 provides buoyancy to assist the user in rotating to a vertical position when desired.

Optional features of the present invention could include the following: adjustable fasteners for proper fit; and pockets or channels for multiple buoyant pads to be added or removed for adjustment of desired buoyancy.

As can be seen from the above, the invention provides a restoring force that biases the user to a vertical position, like an inflatable pop-up toy punching bag, but the restoring force is low enough that the user can easily rotate to a horizontal position, thus giving the user the confidence of knowing that, from a horizontal position to learn to swim, he or she can easily rotate back to a vertical position without any assistance, with head, neck and shoulders above the water. The invention also provides sufficient buoyancy that the user's head, neck and shoulders can be kept above water when the user is swimming in a horizontal position. Thus, the invention combines a vertical restoring force with sufficient flotation to keep the user's head, neck and shoulders above the water.

Buoyancy of the floats can be provided in any manner, such as by making the floats from polyurethane, polyethylene, ethylene-vinyl acetate, or other foam. The floats can also be inflatable pads, filled with specific gases for a desired level of buoyancy.

While the present invention has been disclosed in connection with the presently preferred embodiments described herein, it will be obvious to those of ordinary skill in the art that various changes may be made in the preferred embodiments described herein without departing from the spirit and scope of the invention. Also, there may be other embodiments which fall within the spirit and scope of the invention, as defined by the claims, including equivalents thereof. Accordingly, the invention shall not be limited by what is shown in the drawings and described in the specification, and no limitations shall be implied or inferred in the scope of the invention, except as specifically and explicitly set forth in the claims.

INDUSTRIAL APPLICABILITY

The present invention is applicable whenever it is desired to teach anyone how to swim, young or old, or whenever someone who knows how to swim, but is not able to (or does not desire to) expend the physical exertion necessary to swim and breathe, wishes to swim, such as the elderly or the injured.

What is claimed is:

1. A swimming aid for supporting a user in water, comprising:

a lower back float having a top edge, retainable around said user's lower back;

a lower harness attached to said lower 14 back float, adaptable to retain said lower back float around said user's lower back;

an abdominal float having a bottom edge retainable against said user's abdomen;

an abdominal harness attached to said abdominal float, adaptable to retain said abdominal float against said user's abdomen;

wherein said floats provide sufficient buoyancy to keep said user's head, neck and shoulders above said water when said user is in a vertical position and in a mostly horizontal position;

wherein said lower back float provides greater buoyancy than said abdominal float to bias said user against falling backwards or sideways; and wherein when said lower harness and said abdominal harness are worn by said user, said lower back float is retained around said user's lower back and said abdominal float is retained against said user's abdomen, and said bottom edge of said abdominal float is below said top edge of said lower back float when said user is in a vertical position in said water, whereby said floats overlap axially;

whereby said abdominal float and said lower back float are axially close enough that said user is biased to a vertical position, but said user can easily rotate between a mostly horizontal position for learning how to swim, and a vertical position, with head, neck and shoulders above said water in both of said positions, for ease and comfort of breathing, without falling over backwards or sideways.

2. A swimming aid according to claim 1, wherein said lower harness and said abdominal harness are integrally formed.

3. A swimming aid according to claim 1, wherein said lower back float subtends an angle of between about 180 degrees and about 250 degrees around the back of the user.

4. A swimming aid according to claim 1, wherein said lower back float subtends an angle of between about 190 degrees and about 240 degrees around the back of the user.

5. A swimming aid according to claim 1, wherein said lower back float subtends an angle of between about 210 degrees to about 230 degrees around the back of the user.

6. A swimming aid according to claim 1, wherein said abdominal float comprises two abdominal sub-floats.

7. A swimming aid according to claim 1, wherein said abdominal float subtends an angle of between about 90 degrees and about 180 degrees around the abdomen of the user.

8. A swimming aid according to claim 1, wherein said abdominal float subtends an angle of between about 45 degrees and about 90 degrees around the abdomen of the user.

9. A swimming aid according to claim 1, wherein said abdominal float subtends an angle of between about 140 degrees to about 160 degrees around the abdomen of the user.

10. A swimming aid for supporting a user in water, comprising:

a lower back float covering said user's lower back; and an abdominal float covering said user's abdomen;

wherein said lower back float provides greater buoyancy than said abdominal float;

wherein said floats provide sufficient buoyancy to keep said user's head, neck and shoulders above said water when said user is in a vertical position and in a mostly horizontal position;

wherein said lower back float subtends an angle of between about 190 degrees and about 240 degrees around the back of the user;

wherein said abdominal float subtends an angle of about 45 degrees around the abdomen of the user; and wherein said abdominal float and said lower back float overlap axially;

whereby said floats provide a restoring force to bias said user to a substantially vertical position in said water and bias said user against falling backwards or sideways; and whereby said abdominal float and said lower back float are axially close enough that said user is biased to a vertical position, but said user can easily rotate between a mostly horizontal position for learning how to swim, and a vertical position, with head, neck and shoulders above said water in both of said positions, for ease and comfort of breathing, without falling over backwards or sideways.

11. A swimming aid for supporting a user in water, comprising:

a lower back float covering a lower back portion of said user's torso and wrapping about ⅔ around said user at said user's lower back; and an abdominal float covering a front abdominal portion of said user's torso and wrapping about ⅛ around said user at said user's abdomen;

wherein said floats provide sufficient buoyancy to keep said user's head, neck and shoulders above said water when said user is in a vertical position and in a mostly horizontal position;

wherein said lower back float provides greater buoyancy than said abdominal float; and wherein said abdominal float and said lower back float overlap axially;

whereby said abdominal float and said lower back float are axially close enough that said user is biased to a vertical position, but said user can easily rotate between a mostly horizontal position for learning how to swim, and a vertical position, with head, neck and shoulders above said water in both of said positions, for ease and comfort of breathing, without falling over backwards or sideways.

12. A swimming aid for supporting a user in water, comprising:

a float having a lower back portion having a top edge retainable against a user's lower back, and an abdominal portion having a bottom edge retainable against a user's abdomen;

wherein said float provides sufficient buoyancy to keep said user's head, neck and shoulders above said water when said user is in a vertical position and in a mostly horizontal position;

wherein said portions overlap axially, whereby said bottom edge of said abdominal portion is below said top edge of said lower back portion when said user wears said float and is in a vertical position in said water;

whereby said abdominal portion and said lower back portion are axially close enough that said user is biased to a vertical position, but said user can easily rotate between a mostly horizontal position for learning how to swim, and a vertical position, with head, neck and shoulders above said water in both of said positions, for ease and comfort of breathing, without falling over backwards or sideways.

* * * * *